US012371875B2

(12) United States Patent
Koenig

(10) Patent No.: US 12,371,875 B2
(45) **Date of Patent: *Jul. 29, 2025**

(54) MOBILE GRADING MACHINE WITH IMPROVED GRADING CONTROL SYSTEM

(71) Applicant: Deere & Company, Moline, IL (US)

(72) Inventor: Carl J. Koenig, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/475,525

(22) Filed: Sep. 27, 2023

(65) Prior Publication Data

US 2024/0026638 A1 Jan. 25, 2024

Related U.S. Application Data

(63) Continuation of application No. 17/165,439, filed on Feb. 2, 2021, now Pat. No. 11,873,617.

(51) Int. Cl.

| | |
|---|---|
| ***E02F 3/84*** | (2006.01) |
| ***E02F 3/76*** | (2006.01) |
| ***E02F 9/26*** | (2006.01) |

(52) U.S. Cl.

CPC ..... *E02F 3/844* (2013.01); *E02F 3/7613* (2013.01); *E02F 3/7618* (2013.01); *E02F 9/262* (2013.01); *E02F 9/265* (2013.01)

(58) Field of Classification Search

CPC ... E02F 3/844; E02F 3/845; E02F 3/16; E02F 3/43; E02F 3/7613; E02F 3/7618;

(Continued)

(56) References Cited

U.S. PATENT DOCUMENTS 5,009,546 A 4/1991 Domenighetti et al.
5,515,927 A 5/1996 Matsushita et al.

(Continued)

FOREIGN PATENT DOCUMENTS

CN 108951750 A * 12/2018
DE 102007051198 A1 5/2008

(Continued)

OTHER PUBLICATIONS

Strange et al., Development of a Real-time Georeferenced Subsurface Radar System for Mining Applications, 2011, IEEE (Year: 2011).*

(Continued)

*Primary Examiner* — Russell Frejd
*Assistant Examiner* — Sara J Lewandroski
(74) *Attorney, Agent, or Firm* — Christopher J. Volkmann; KELLY, HOLT & CHRISTENSON, P. L. L. C.

(57) ABSTRACT

A mobile work machine includes a first grade control system that receives a an external reference position signal from a geographic positioning system, and generates blade control signals to control an orientation of a blade in grading a worksite. The mobile work machine also includes a second grade control system that uses blade mainfall and cross slope as well as chassis (or mainframe) mainfall and cross slope to control the orientation of the blade relative to the frame of the work machine to create a planar grade of a desired mainfall and cross slope. When functionality of the first grade control system is interrupted, the mobile work machine automatically switches to using the second grade control system to perform the grading operation, until the interruption to the functionality of the first grade control system is restored.

19 Claims, 7 Drawing Sheets

(58) Field of Classification Search
CPC . E02F 9/262; E02F 9/264; E02F 9/265; E02F 9/625; E02F 9/267; E02F 9/268; E02F 5/145; G01S 19/00; G01S 19/01; G01S 19/38; G01S 19/39; G01S 19/396; G01S 19/40; G01S 19/42; G01S 19/45; G01S 19/47; G01S 19/48; G01S 19/485; G01S 19/49; G01S 19/51; G01S 2201/03
See application file for complete search history.

(56) References Cited

U.S. PATENT DOCUMENTS

| | | | | |
|---|---|---|---|---|
| 5,551,518 | A * | 9/1996 | Stratton | E02F 3/845 701/50 |
| 5,631,658 | A | 5/1997 | Gudat et al. | |
| 8,705,022 | B2 * | 4/2014 | Taylor | G01S 17/86 356/139.01 |
| 9,938,689 | B2 * | 4/2018 | Chaston | E02F 3/7604 |
| 11,873,617 | B2 * | 1/2024 | Koenig | E02F 3/7618 |
| 2007/0052950 | A1 * | 3/2007 | Taylor | G01S 17/86 356/622 |
| 2012/0059554 | A1 * | 3/2012 | Omelchenko | G05D 1/0274 701/50 |
| 2017/0097248 | A1 | 4/2017 | Hohla et al. | |
| 2017/0097249 | A1 | 4/2017 | Hohla et al. | |
| 2017/0107700 | A1 | 4/2017 | Faivre et al. | |
| 2019/0204852 | A1 | 7/2019 | Fritz et al. | |
| 2022/0222392 | A1 * | 7/2022 | Ishihara | E02F 9/20 |
| 2022/0243423 | A1 | 8/2022 | Koenig | |

FOREIGN PATENT DOCUMENTS

| | | | |
|---|---|---|---|
| DE | 102019208302 | A1 | 1/2020 |
| DE | 102019121416 | A1 | 2/2020 |
| DE | 112007002393 | B4 | 3/2020 |
| DE | 1120070022393 | | 3/2020 |
| DE | 69610479 | T2 | 5/2021 |
| WO | 2009038929 | A1 | 4/2009 |
| WO | 2009039929 | A1 | 4/2009 |

OTHER PUBLICATIONS

German Search Report issued in application No. DE102021213706.7 dated Aug. 31, 2022, 10 pages.
U.S. Appl. No. 17/165,439, filed Feb. 2, 2021, Application and Drawings, 31 pages.
U.S. Appl. No. 17/165,439 Notice of Allowance dated Sep. 20, 2023. 9 pages.
U.S. Appl. No. 17/165,439 Office Action dated Jun. 21, 2023, 19 pages.
U.S. Appl. No. 17/165,439 Non Final Office Action dated Jun. 21, 2023, 20 pages.

* cited by examiner

MOBILE GRADING MACHINE WITH IMPROVED GRADING CONTROL SYSTEM

CROSS-REFERENCE TO RELATED APPLICATION

The present application is a continuation of and claims priority of U.S. patent application Ser. No. 17/165,439, filed Feb. 2, 2021, the content of which is hereby incorporated by reference in its entirety.

FIELD OF THE DESCRIPTION

The present description relates to mobile work machines. More specifically, the present description relates to mobile work machines that are used in performing grading operations.

BACKGROUND

There are many different types of mobile work machines. Some mobile work machines include construction machines that can be controlled to perform grading operations at a worksite.

For instance, some such work machines include an implement (such as a blade) that is used to grade the worksite. A grader, for instance, has a blade that is movable to change the height and angle of the blade. A crawler is generally a tracked machine that has a blade that can be raised or lowered, as well as rotated, in order to grade a worksite. These are simply examples of mobile work machines that have a blade this is movable in multiple degrees of freedom, to interact with the worksite. Achieving a proper grade at a worksite is often a first step of the entire operation, and a last step to finish the operation.

The discussion above is merely provided for general background information and is not intended to be used as an aid in determining the scope of the claimed subject matter.

SUMMARY

A mobile work machine includes a first grade control system that receives an external reference position signal from a geographic positioning system, and generates blade control signals to control an orientation of a blade in grading a worksite. The mobile work machine also includes a second grade control system that uses blade mainfall and cross slope as well as chassis (or mainframe) mainfall and cross slope to control the orientation of the blade relative to the frame of the work machine to create a planar grade of a desired mainfall and cross slope. When functionality of the first grade control system is interrupted, the mobile work machine automatically switches to using the second grade control system to perform the grading operation, until the interruption to the functionality of the first grade control system is restored.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Figure 1:
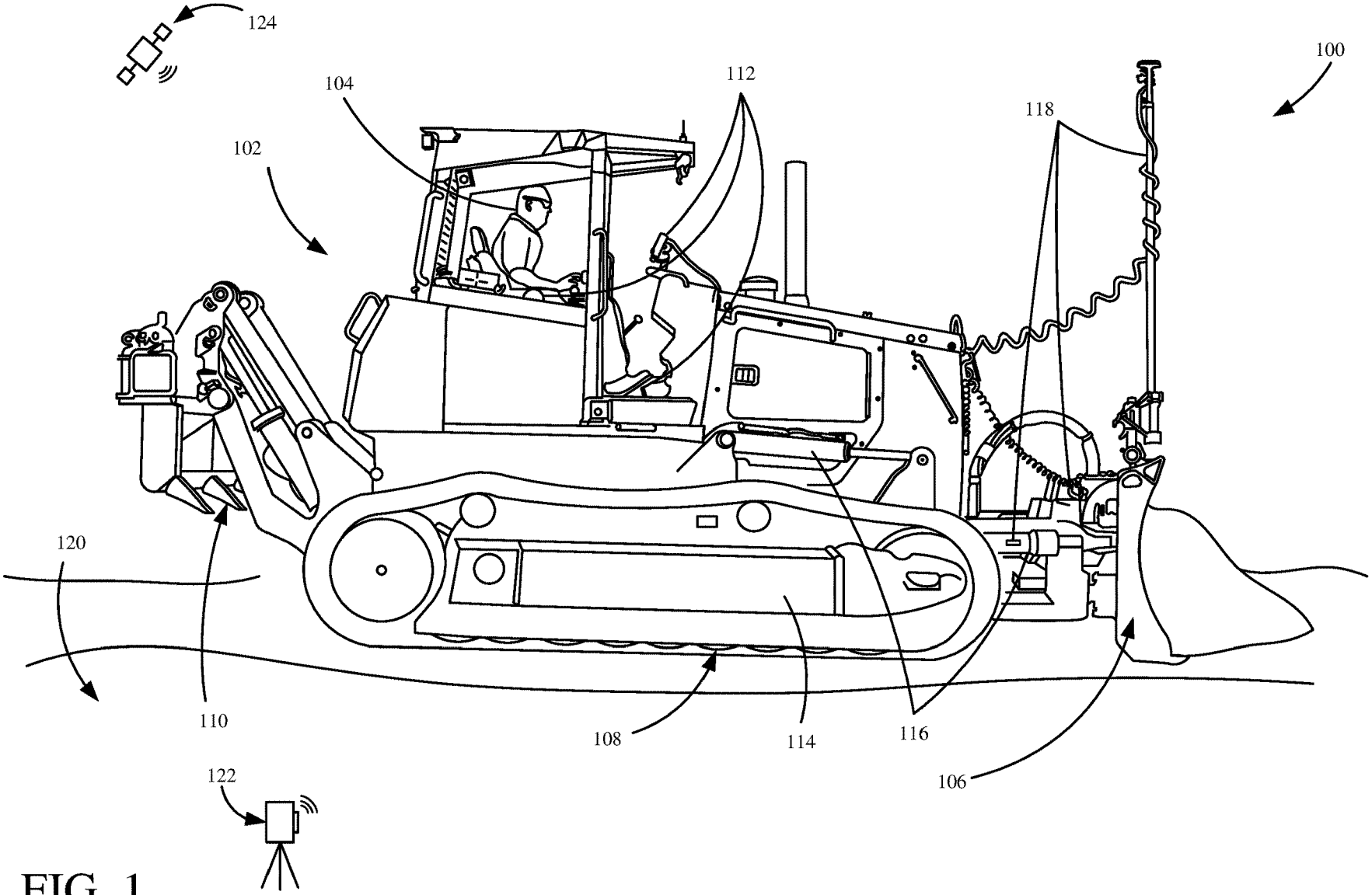
FIG. 1 is a pictorial illustration of one example of a mobile work machine.

As discussed above, some mobile work machines control actuators in order to control the orientation of a blade in performing a grading operation on a worksite. There are a plurality of different types of automatic grade control systems that can be used to automatically control the position or orientation of the blade in order to obtain a specified grading operation. By way of example, one automatic grade control system is referred to as a three-dimensional (3D) grade control system. A 3D grade control system receives a position signal, which represents an external reference indicative of the geographic location or position of the machine. The external reference can be a position signal from a satellite in a global navigation satellite system (GNSS). By way of example, there may be a satellite signal receiver on the blade or elsewhere on the mobile work machine that receives, as the external reference, a position signal from the GNSS satellite. Similarly, a 3D grade control system may receive, as the external reference, a position signal from a local positioning system (or LPS), such as a total station. The 3D control system receives the external reference position information or position signal, and uses it to calculate how to orient the blade in order to perform a grading operation based upon a predefined plan that indicates the designed grade for the workspace.

Another example of an automatic grade control system is a two dimensional (2D) grade control system. A 2D grade control system does not use an external reference of machine position. Instead, a 2D grade control system uses sensors to sense the orientation of the blade (e.g., mainfall and cross slope), on the mobile work machine, relative to another piece of the mobile work machine, such as the frame (e.g., chassis or mainframe) of the mobile work machine or relative to gravity or another way. The 2D grade control system attempts to control the orientation of the blade, in order to produce a planar grade of a desired cross slope and mainfall.

It sometimes happens that, while the 3D grade control system is activated, some functionality of the 3D grade control system is interrupted. For instance, the mobile work machine may enter a location where the external reference (e.g., the position signal) is interrupted. If the position signal is received from a GNSS satellite, for example, the grader may go under an overpass or under some other obstruction that blocks the mobile work machine from receiving the GNSS signal. Also, a 3D grade control system only provides desired grade control signals in a design area covered by the model or map that represents the desired design. If the machine leaves the design area, the 3D control system does not accurately control the blade. Similarly, local positioning systems often rely on line of sight in order to transmit a position signal to the mobile work machine. Therefore, the mobile work machine may move to a position where the line of sight is obstructed by a physical structure, or where it is obstructed by terrain, obscurants, or other items. In these scenarios, where the 3D grade control system is activated, and the external reference (e.g., the position signal) is interrupted, the 3D grade control system stops making corrections to the orientation of the blade so that the grading operation can quickly become inaccurate. Therefore, in these scenarios, the operator may observe that the 3D grade control system is no longer functioning properly, and assume manual control to attempt to manually control the blade. The operator may then, at some later point, attempt to reactivate the 3D grade control system.

The present description thus proceeds with respect to a control system that monitors the presence of the external reference (e.g., position signal) and also monitors the orientation of the blade and monitors a predefined target orientation (mainfall and cross slope) for a designated grade, so that the monitored and target orientations can be used by a 2D grade control system. When the control system detects that the position signal is interrupted (e.g., is no longer being received at the mobile work machine or that the strength of the position signal is insufficient to accurately convey position), then the control system automatically switches to controlling the mobile work machine automatically with the 2D grade control system, using the most recently known blade orientation and target orientation, instead of using the 3D grade control system. The operator can be notified that the automatic 2D system is now controlling the work machine, and the 3D system is no longer controlling the work machine. The operator can be notified, and the control system can automatically switch back to using the 3D grade control system when the position signal is re-acquired.

FIG. 1 is a side view showing an example of worksite 100. Worksite 100 includes a mobile work machine 102 that can be controlled by an operator 104. FIG. 1 shows that machine 102 is a dozer crawler. However, in other examples, machine 102 can be a grader, a skid steer loader, a scraper, or other mobile work machines. Operator 104 illustratively interacts with machine 102 through user interface mechanisms 112. User interface mechanisms 112 can include a screen, joystick, pedals, steering wheels, levers, switches, buttons, touch screens, microphones, or a wide variety of other user interface mechanisms. The user interface mechanisms can be used to surface, display or otherwise present information to user 104 and to detect user inputs for controlling and manipulating mobile work machine 102.

FIG. 1 also shows a powertrain assembly 108 which transfers power from a power source (such as an engine) to ground engaging elements, such as tracks. Operator 104 can control powertrain 108 using user interface mechanisms 112. FIG. 1 also shows that mobile work machine 102 can include blade 106, and ripper 110. Blade 106 can be any of a wide variety of different types of blades that can be orientated differently relative to a frame (e.g., chassis or mainframe) 114 of mobile work machine 102 or relative to gravity or in some other way. Controlling blade orientation can be done using a set of actuators 116. For instance, blade 106 may be a 6-way blade that can be positioned or oriented to affect the worksite terrain 120 of worksite 100 in a. desired way.

As discussed above, operator 104 can be assisted in controlling the position and/or orientation of blade 106 by an autonomous or semi-autonomous grade control system which is shown in greater detail below. For example, one or more sensors 118 can sense conditions of the terrain 120 on worksite 100 and/or can sense characteristics of machine 102 to assist in automatic or semi-automatic control of machine 102. Sensors 118 can include a wide variety of different types of sensors. For instance, sensors 118 can include one or more of sensors on frame 114 of machine 102, on blade 106, on actuators 116 that control the position and orientation of the blade 106, and that control the position and orientation of blade 106 relative to the ground, relative to the frame 114 of machine 102, relative to gravity or in another way. Sensors 118 may include an external reference sensor, such as one or more of geographic position sensors, (e.g., GNSS receivers that receive position/location signals from a satellite 124), or a receiver that receives signals from a local positioning system transmitter 122. The sensors can also include accelerometers, internal measurement units, gyroscopes, linear displacement transducers, range scanners such as LIDAR or RADAR, cameras, among other things. In one example, sensors 118 monitor the height and orientation of blade 106 relative to frame 114 or powertrain 108 such that the cutting depth and the angle with which blade 106 engages the ground 120 (e.g., the mainfall and cross slope of the grade) are known.

Figure 2:
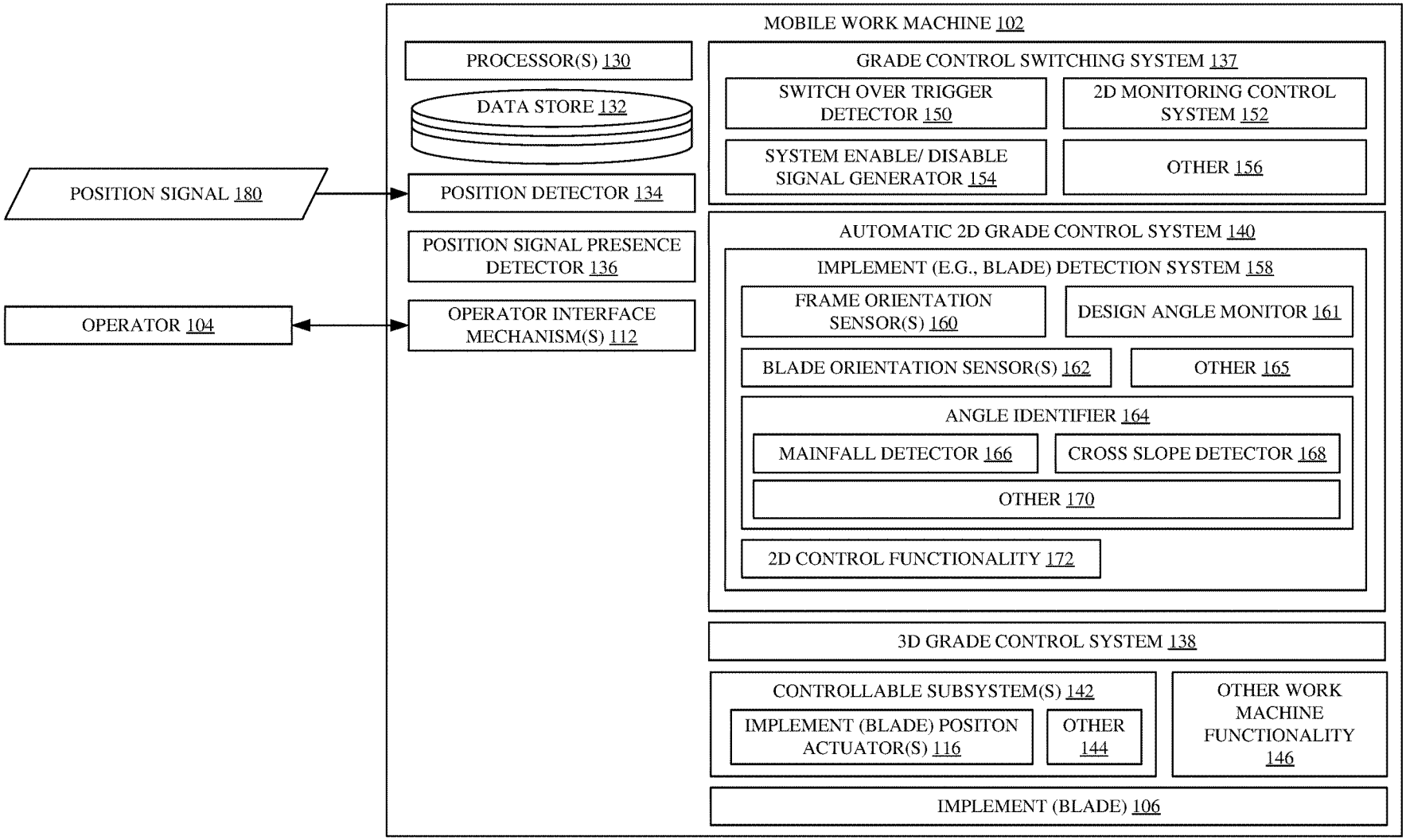
FIG. 2 is a block diagram showing one example of the mobile work machine, in more detail.

FIG. 2 is a block diagram showing one example of mobile work machine 102 in more detail. Some items shown in FIG. 2 are similar to those shown in FIG. 1, and they are similarly numbered. In the example shown in FIG. 2, mobile work machine 102 includes one or more processors 130, data store 132, a position detector 134 (which may be one of the sensors 118 discussed above with respect to FIG. 1), grade control switching system 137, position signal presence detector 136, operator interface mechanisms 112, 3D grade control system 138, automatic 2D grade control system 140, one or more controllable subsystems 142 (which can include implement position actuators 116 and other items 144), other work machine functionality 146, and implement (e.g., blade) 106. Grade control switching system 137 can include switchover trigger detector 150, 2D monitoring control system 152, system enable/disable signal generator 154 and it can include other items 156. Automatic 2D grade control system 140 may include implement (e.g., blade) detection system 158. System 158 can include one or more of frame orientation sensor 160, design angle monitor 161, blade orientation sensors 162, angle identifier 164 and other items 165. Design angle monitor 161 monitors a target angle (e.g., target cross slope and mainfall angles of the grade) for blade 106 based on an as-designed model, which may be stored in data store 132. Angle identifier 164 can receive the sensor signals from sensors 160 and 162 and mainfall detector can identify an orientation of frame 114, and/or blade 106, and/or the grade mainfall angle while cross slope detector 168 can identify an orientation of frame 114 and/or blade 106 and/or the cross slope of the grade. Angle identifier 164 can include other angle identifiers 170 as well. Also, implement detection system 158 can include 2D control functionality 172. Before describing the overall operation of mobile work machine 102, a brief description of some of the items in mobile work machine 102, and their operation, will be provided.

Position detector 134 illustratively receives an external reference indicative of the geographic location or position of machine 100 or a portion of machine 100. For instance, the external reference may be a geographic position signal 180 from a position signal transmitter, such as local position system 122 or GNSS satellite 124. Position detector 134 generates a position signal (e.g., geographic location and/or orientation) of machine 102 based upon the position signal 180. The geographic location and/or orientation of various parts of machine 102 can be sensed or derived from the position signal as well. Position signal presence detector 136 detects whether the position signal 180 is, for some reason, interrupted. When position signal 180 is interrupted, this means that 3D grade control system 138 will not operate properly. Thus, position signal presence detector 136 can detect the interruption of position signal 180 and provide an indication of this to grade control switching system 137. It should be noted that position signal presence detector 136 can detect the interruption of position signal 180 within position detector 134, or external to position detector 134, or in other ways.

3D grade control system 138 can be activated by operator 104 through operator interface mechanisms 112, or in other ways. When activated, 3D grade control system 138 generates control signals to control controllable subsystems 104 so that the implement 106 is controlled and oriented in a desired way, to engage the ground in a desired way to perform a desired grading operation, based upon, for example, a pre-defined, as finished, model. In generating such control signals, 3D grade control system 138 receives the position signal from position detector 134. Without the position signal, 3D grade control system 138 does not make corrections to the orientation and position of implement 106. Instead, operator 104 may notice that 3D grade control system 138 is operating improperly, and assume manual control of implement 106 using operator interface mechanisms 112.

Automatic 2D grade control system 140 can use 2D control functionality 172 and the orientation of frame 114, the orientation of the blade 106 (e.g., relative to gravity or relative to the frame 114 or powertrain) and the target mainfall and cross slope of the grade to control the blade to make a desired planar cut at a desired mainfall and cross slope. Thus, automatic 2D control system 140 generates control signals to control the controllable subsystems 142 (e.g., the position actuators 116 which position the implement or blade 106).

During operation, assume first that the operator has activated 3D grade control system 138 so that system 138 is controlling the blade 106 based on inputs from sensor signals (such as position detector 134) and based on a design model. During the operation of 3D grade control system 138, automatic 2D grade control system 140 monitors target mainfall and cross slope of the grade being created by blade 106. This monitoring can be done in a variety of different ways. In one example, automatic 2D grade control system 140 monitors the frame orientation using frame orientation sensor 160, and also monitors the blade orientation using blade orientation sensor 112. In another example, 3D grade control system 138 updates automatic 2D grade control system 140 by sending 2D grade control system 140 updated target or actual values for the grade mainfall and cross slope. 2D monitor control system 152 monitors and stores the target mainfall angles and cross slope angles generated by mainfall detector 166 and cross slope detector 168 (based upon the input from sensors 160 and 162), and the target angles obtained by design angle monitor 161, and/or the angles or other position information communicated to the automatic 2D grade control system from the 3D grade control system.

Switchover trigger detector 150 receives an input from position signal presence detector 136. When the signal from detector 136 indicates that the position signal 180 has been interrupted, switchover trigger detector 150 detects this as a trigger to switch from automatically controlling machine 102 with 3D grade control system 138 to automatically controlling machine 102 with 2D grade control system. In one example, by automatic it is meant that the operation is performed without further human inputs except, perhaps, to initiate or authorize the operation. Grade control switching system 137 notifies operator 104 of the switch through operator interface mechanisms 112. System enable/disable signal generator 154 thus generates signals to automatically disable 3D grade control system 138 and enable 2D grade control system 140. 2D control functionality 172 accesses the target mainfall angle and cross slope angle of the grade most recently obtained by 2D monitoring control system 152 and design angle monitor 161 and uses those angles to automatically control the orientation of implement 106 using actuators 116.

When position signal presence detector 136 again detects the presence of position signal 180, detector 136 provides an indication of this to switchover trigger detector 150 which identifies the presence of position signal 180 as a switchover trigger to switch back to controlling machine 102 using the 3D grade control system 138 instead of using automatic 2D grade control system 140. System enable/disable signal generator 154 then generates control signals to disable 2D grade control system 140 and enable 3D grade control system 138. 2D monitoring control system 152 continues to monitor the mainfall and cross slope angles detected by implement detection system 158 and monitor 161 monitors the target angles so that, if the position signal 180 is again interrupted, 2D grade control system 140 can again take over automatic control of machine 100.

It should also be noted that, when a switchover trigger is detected by switchover trigger detector 150, an output can be generated to operator interface mechanisms 112 to indicate to operator 104 that the grade control system being used to control mobile work machine 102 has switched, either from 3D grade control system 138 to 2D grade control system 140, or from 2D grade control system 140 to 3D grade control system 138. The notification to operator 104 can be visual and/or audio and/or haptic, or by using other notification mechanisms.

Figure 3:
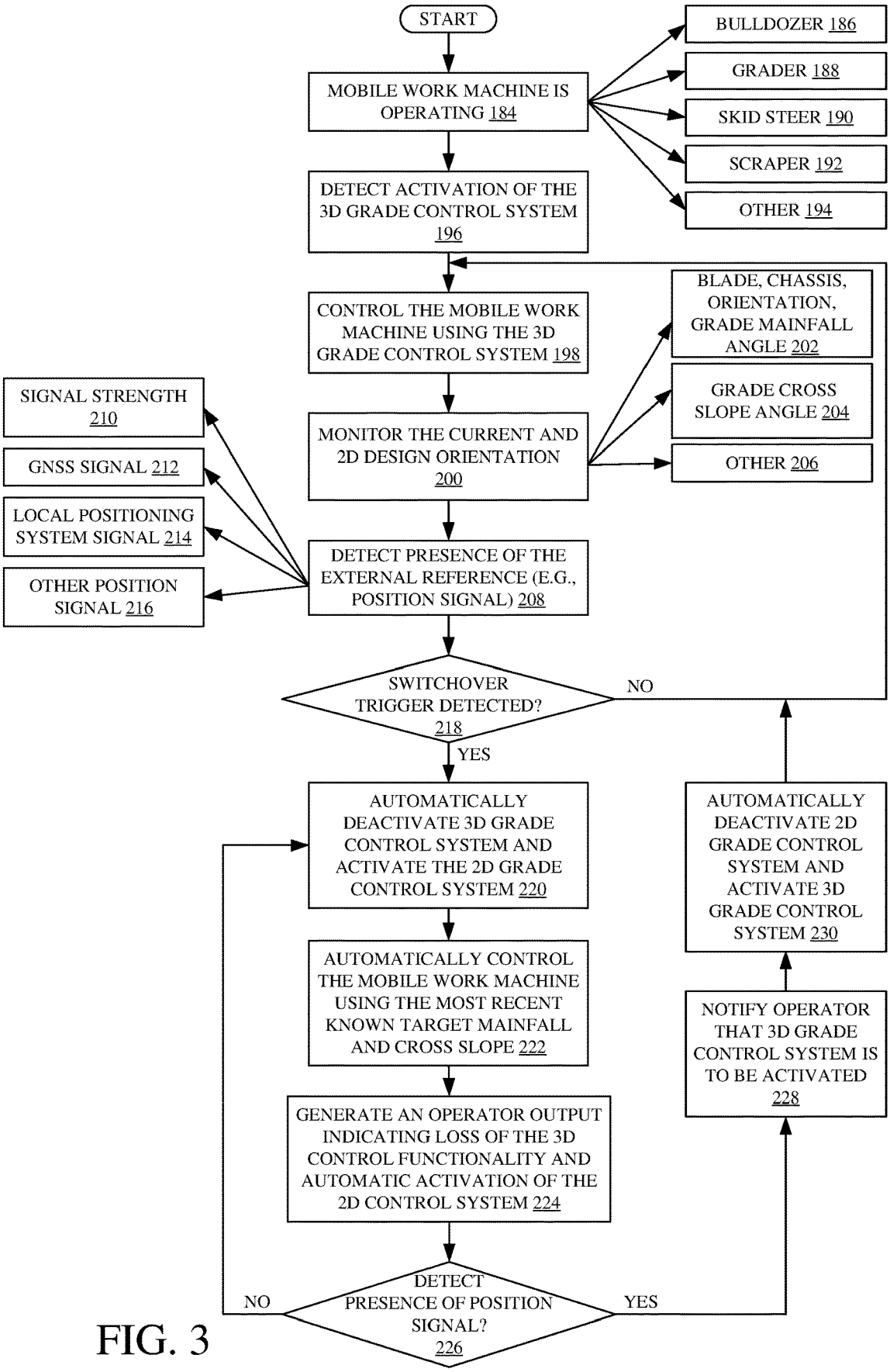
FIG. 3 is a flow diagram illustrating one example of the operation of the mobile work machine in switching between two different grade control systems.
Figure 4:
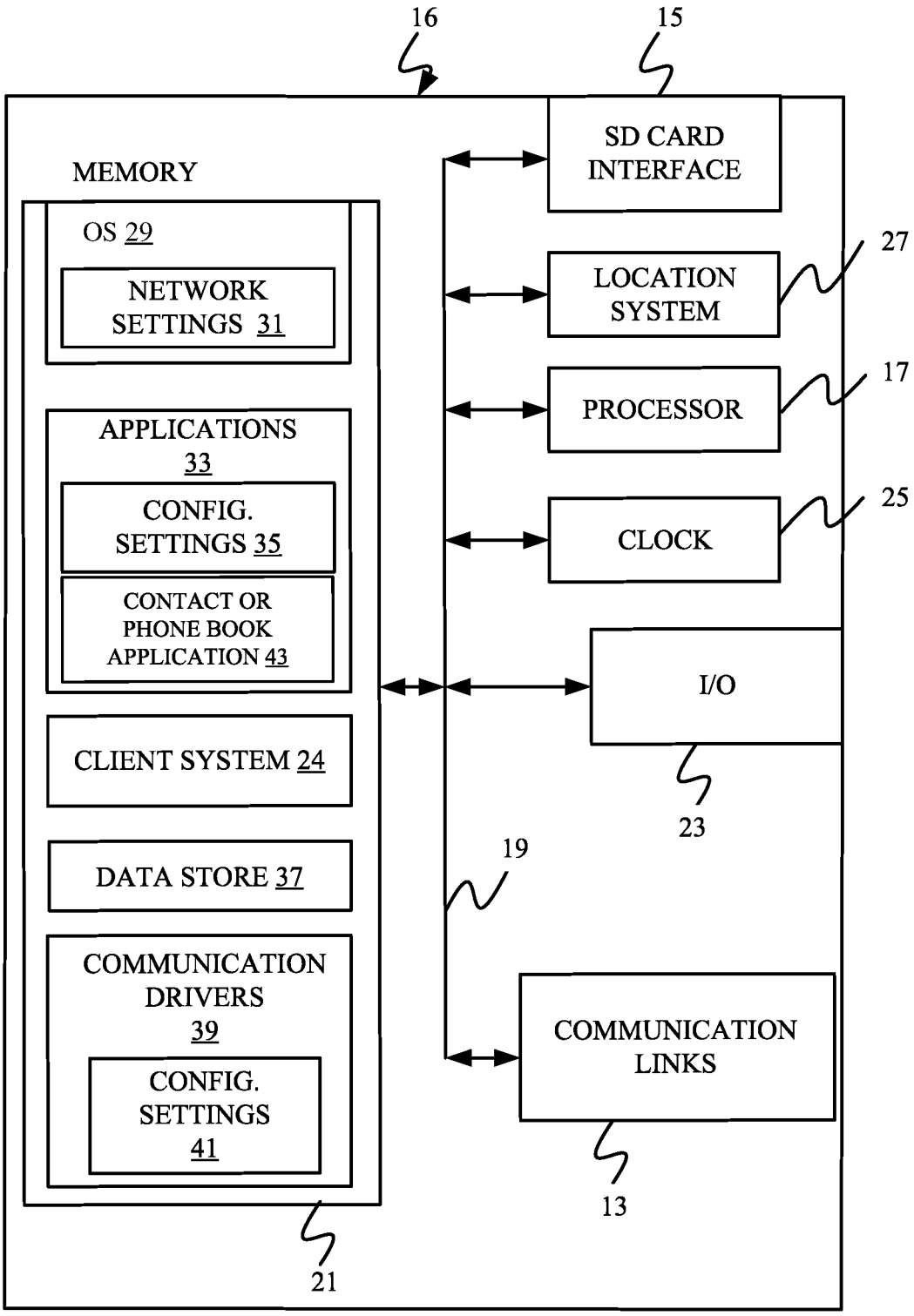
FIGS. 4-6 show examples of mobile devices that can be used with the mobile work machines described in various Figures.

FIG. 3 is a flow diagram illustrating one example of the operation of mobile work machine 102 in monitoring the presence and/or interruption of position signal 180 and switching between automatically controlling machine 102 with 3D grade control system 138 and 2D grade control system 140. It is first assumed that the mobile work machine 102 is operating. This is indicated by block 184 in the flow diagram of FIG. 3. Again, mobile work machine 102 can be a bulldozer 186, a grader 188, a skid steer loader 190, a scraper 192, or another mobile work machine that has a blade or other implement that engages the ground in a desired orientation.

At some point, operator 104 provides an input through operator interface mechanisms 112 to activate 3D grade control system 138. 3D grade control system 138 then begins controlling the controllable subsystems 142 (such as the actuators 116 that control the position of blade 106) based upon the position signal from position detector 134, based upon a pre-defined, desired grade (e.g., mainfall and cross slope) from a model or other system, and based upon other sensor inputs. Detecting activation of the 3D grade control system is indicated by block 196 in the flow diagram of FIG. 3. Controlling the mobile work machine using the 3D grade control system 138 is indicated by block 198 in the flow diagram of FIG. 3.

While 3D grade control system 138 is controlling the controllable subsystems 142, implement detection system 158 continues to detect the angles of blade 106 and frame 114 that may be needed by 2D grade control system 140 to automatically control the blade. In another example, implement detection system 158 receives, from 3D grade control system 138, the grade mainfall and cross slope angles or other angles. 2D monitoring control system 152 continues to store values, for example, of the mainfall angle and the cross slope angle. These angles can include mainfall and cross slope angles of the graded work surface, the orientation of blade 106, and/or the orientation of frame 114. In another example, design angle monitor 161 can also continue to monitor the design angle (e.g., from the design model which indicates the desired angle or orientation of blade 106 and/or the target mainfall and cross slope, according to the design).

Monitoring the current mainfall and cross slope angles of the grade and/or the orientation of the blade 106, and/or the frame 114, and monitoring the desired design mainfall and cross slope angles (or target orientation) is indicated by block 200 in the flow diagram of FIG. 3. Detecting the current and design orientation of the blade and/or chassis and/or the mainfall of the graded surface is indicated by block 202. Monitoring the current and design cross slope angles is indicated by block 204. Other angles or orientation indicators can be monitored as well, as indicated by block 206.

Also, position signal presence detector 136 continues to detect the presence of the external reference (e.g., geographic position signal) 180. Detecting the external reference is indicated by block 208 in the flow diagram of FIG. 3. The signal strength of the geographic position signal 180 can be detected as well, as indicated at block 210. The geographic position signal 180 can be detected from a GNSS signal 212, or a local positioning system as indicated by block 214. The geographic position signal 180 can be coming from another source as well, as indicated by block 216.

At some point, it may be that the geographic position signal 180 is interrupted. The signal interruption is detected by detector 136 and a signal indicative of the detected interruption is provided to switchover trigger detector 150. So long as the geographic position signal 180 is present, processing reverts to block 198 where 3D grade control system 138 continues to control machine 102. However, if, at block 218, trigger detector 150 detects that the position signal 180 is interrupted (e.g., no longer present or is too weak), then trigger detector 150 provides an output to system enable/disable signal generator 154 which generates a disable signal to disable 3D grade control system 138 and an enable signal to enable 2D grade control system 140. Automatically deactivating 3D grade control system 138 and automatically activating 2D grade control system 140 is indicated by block 220 in the flow diagram of FIG. 3. The 2D control functionality 172 then automatically controls the mobile work machine 102 using the most recent mainfall and cross slope angles. Functionality 172 can also control machine 102 based on the most recently monitored design mainfall and cross slope angles as well, as indicated by block 222 in the flow diagram of FIG. 3. Signal generator 154 also illustratively generates a signal that controls operator interface mechanisms 112 to generate an operator output indicating loss of the 3D control functionality and automatic activation of the automatic 2D grade control system, as indicated by block 224.

Position signal presence detector 136 continues to detect whether geographic position signal 180 has been re-acquired. Once it has been re-acquired, detector 136 provides a signal to switchover trigger detector 150 indicating that the geographic position signal 180 is again present. Until the geographic position signal 180 is present, as indicated by block 226 in the flow diagram of FIG. 3, processing reverts to block 222 where the 2D grade control system 140 continues to automatically control the grading operation of machine 102.

However, if, at block 226, the geographic position signal 180 is again present, then trigger detector 150 generates an output signal to system enable/disable signal generator 154. Signal generator 154 controls operator interface mechanisms 112 to notify the operator that 3D grade control system 138 is to be reactivated, as indicated by block 228. Signal generator 154 also generates output signals to disable 2D grade control system 140 and to activate 3D grade control system 138, as indicated by block 230 in the flow diagram of FIG. 3. Processing then again reverts to block 198 where 3D grade control system 138 resumes controlling mobile work machine 102. This type of operation can continue until mobile work machine 102 is no longer operating, or until operator 104 provides an input to control mobile work machine 102 in a different way.

It can thus be seen that the present description describes a system that continues to detect whether the geographic position signal 180 is available to the 3D grade control system 138. If not, the system automatically disables the 3D grade control system 138 and begins controlling the blade 106 using the 2D grade control system 140. When the position signal 180 is reacquired, control switches back to the 3D grade control system 138. The operator can be notified of these switchovers as well.

The present discussion has mentioned processors and servers. In one example, the processors and servers include computer processors with associated memory and timing circuitry, not separately shown. They are functional parts of the systems or devices to which they belong and are activated by, and facilitate the functionality of the other components or items in those systems.

Also, a number of user interface displays have been discussed. The displays can take a wide variety of different forms and can have a wide variety of different user actuatable input mechanisms disposed thereon. For instance, the user actuatable input mechanisms can be text boxes, check boxes, icons, links, drop-down menus, search boxes, etc. The user actuatable mechanisms can also be actuated in a wide variety of different ways. For instance, they can be actuated using a point and click device (such as a track ball or mouse). They can be actuated using hardware buttons, switches, a joystick or keyboard, thumb switches or thumb pads, etc. They can also be actuated using a virtual keyboard or other virtual actuators. In addition, where the screen on which the actuatable mechanisms are displayed is a touch sensitive screen, they can be actuated using touch gestures. Also, where the device that displays the actuators has speech recognition components, the actuators can be actuated using speech commands.

A number of data stores have also been discussed. It will be noted they can each be broken into multiple data stores. All can be local to the systems accessing them, all can be remote, or some can be local while others are remote. All of these configurations are contemplated herein.

Also, the figures show a number of blocks with functionality ascribed to each block. It will be noted that fewer blocks can be used so the functionality is performed by fewer components. Also, more blocks can be used with the functionality distributed among more components.

It will be noted that the above discussion has described a variety of different systems, components and/or logic. It will be appreciated that such systems, components and/or logic can be comprised of hardware items (such as processors and associated memory, or other processing components, some of which are described below) that perform the functions associated with those systems, components and/or logic. In addition, the systems, components and/or logic can be comprised of software that is loaded into a memory and is subsequently executed by a processor or server, or other computing component, as described below. The systems, components and/or logic can also be comprised of different combinations of hardware, software, firmware, etc., some examples of which are described below. These are only some examples of different structures that can be used to form the systems, components and/or logic described above. Other structures can be used as well.

It will also be noted that the elements of FIG. 2, or portions of them, can be disposed on a wide variety of different devices. Some of those devices include servers, desktop computers, laptop computers, tablet computers, or other mobile devices, such as palm top computers, cell phones, smart phones, multimedia players, personal digital assistants, etc.

Figure 5:
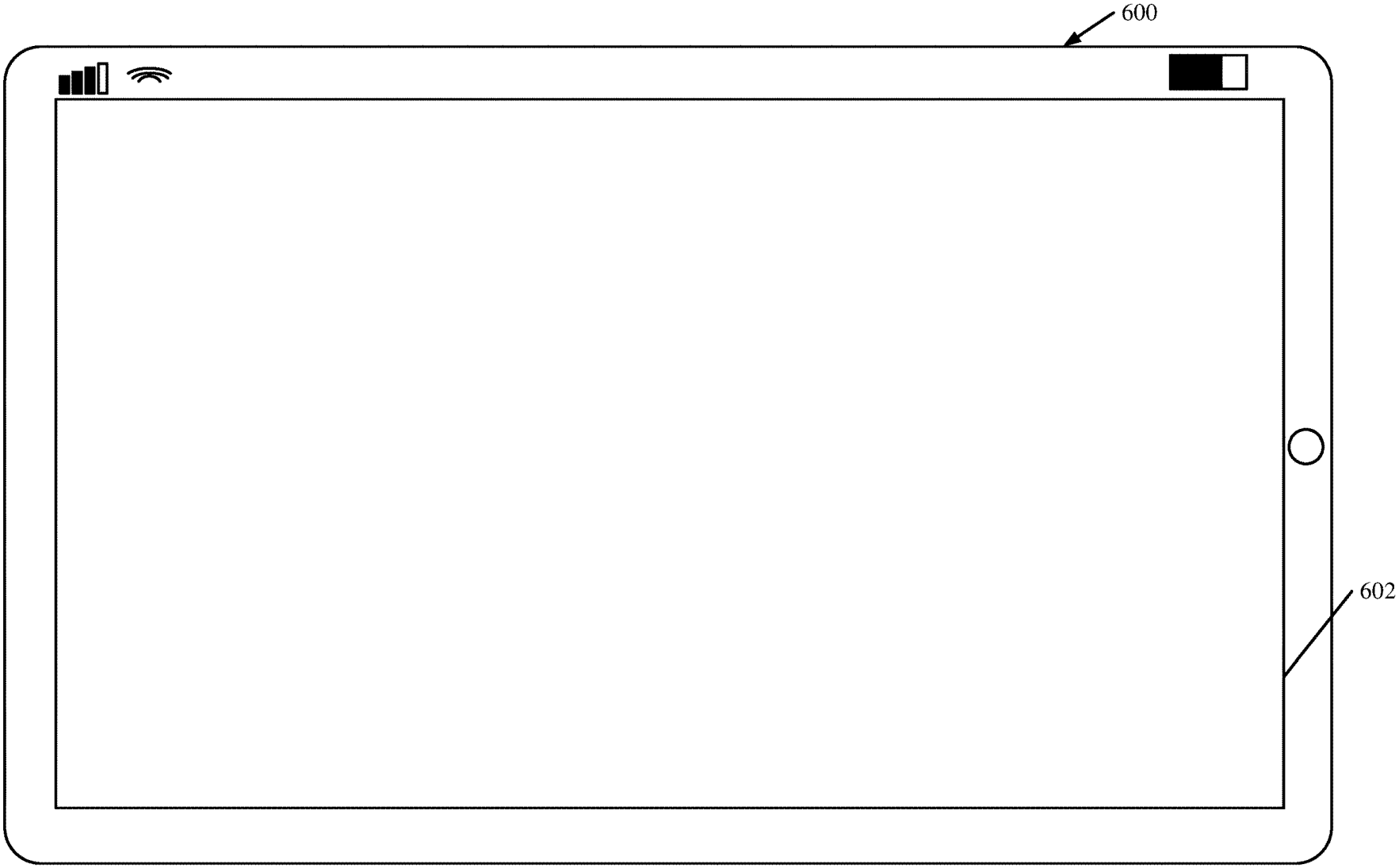
Figure 6:
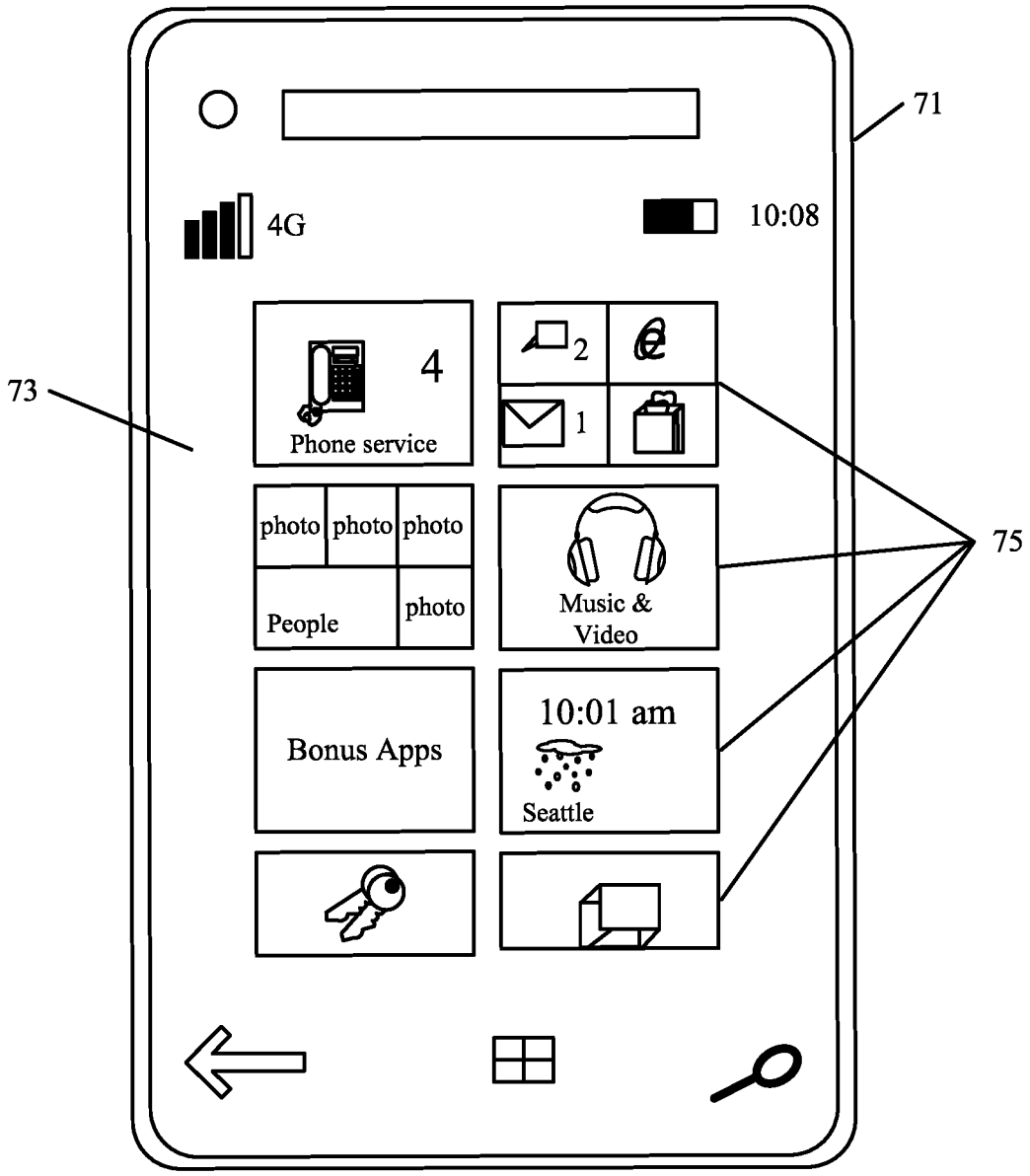
Figure 7:
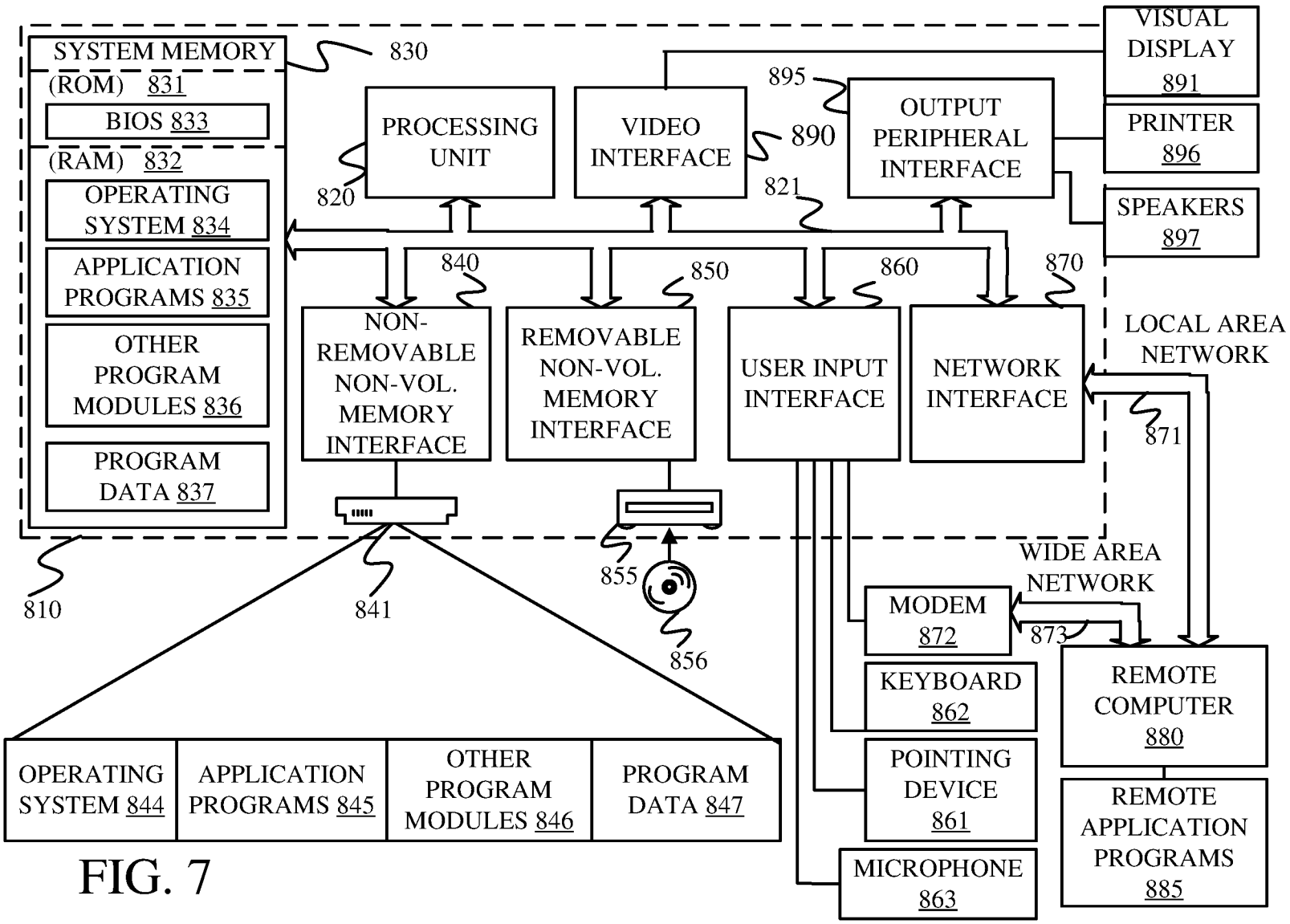
FIG. 7 is a block diagram of one example of a computing environment that can be used with the mobile work machine illustrated and described with respect to the previous figures.

FIG. 5 is a simplified block diagram of one illustrative example of a handheld or mobile computing device that can be used as a user's or client's hand held device 16, in which the present system (or parts of it) can be deployed. For instance, a mobile device can be deployed in the operator compartment of mobile work machine 102 for use in generating, processing, or displaying the data. FIGS. 6-7 are examples of handheld or mobile devices.

FIG. 5 provides a general block diagram of the components of a client device 16 that can run some components shown in FIG. 2, that interacts with them, or both. In the device 16, a communications link 13 is provided that allows the handheld device to communicate with other computing devices and in some examples provides a channel for receiving information automatically, such as by scanning. Examples of communications link 13 include allowing communication though one or more communication protocols, such as wireless services used to provide cellular access to a network, as well as protocols that provide local wireless connections to networks.

In other examples, applications can be received on a removable Secure Digital (SD) card that is connected to an interface 15. Interface 15 and communication links 13 communicate with a processor 17 (which can also embody processors from previous FIGS.) along a bus 19 that is also connected to memory 21 and input/output (I/O) components 23, as well as clock 25 and location system 27.

I/O components 23, in one example, are provided to facilitate input and output operations. I/O components 23 for various examples of the device 16 can include input components such as buttons, touch sensors, optical sensors, microphones, touch screens, proximity sensors, accelerometers, orientation sensors and output components such as a display device, a speaker, and or a printer port. Other I/O components 23 can be used as well.

Clock 25 illustratively comprises a real time clock component that outputs a time and date. It can also, illustratively, provide timing functions for processor 17.

Location system 27 illustratively includes a component that outputs a current geographical location of device 16. This can include, for instance, a global positioning system (GPS) receiver, a LORAN system, a dead reckoning system, a cellular triangulation system, or other positioning system. It can also include, for example, mapping software or navigation software that generates desired maps, navigation routes and other geographic functions.

Memory 21 stores operating system 29, network settings 31, applications 33, application configuration settings 35, data store 37, communication drivers 39, and communication configuration settings 41. Memory 21 can include all types of tangible volatile and non-volatile computer-readable memory devices. It can also include computer storage media (described below). Memory 21 stores computer readable instructions that, when executed by processor 17, cause the processor to perform computer-implemented steps or functions according to the instructions. Processor 17 can be activated by other components to facilitate their functionality as well.

FIG. 6 shows one example in which device 16 is a tablet computer 600. In FIG. 6, computer 600 is shown with user interface display screen 602. Screen 602 can be a touch screen or a pen-enabled interface that receives inputs from a pen or stylus. It can also use an on-screen virtual keyboard. Of course, it might also be attached to a keyboard or other user input device through a suitable attachment mechanism, such as a wireless link or USB port, for instance. Computer 600 can also illustratively receive voice inputs as well.

FIG. 7 shows that the device can be a smart phone 71. Smart phone 71 has a touch sensitive display 73 that displays icons or tiles or other user input mechanisms 75. Mechanisms 75 can be used by a user to run applications, make calls, perform data transfer operations, etc. In general, smart phone 71 is built on a mobile operating system and offers more advanced computing capability and connectivity than a feature phone.

Note that other forms of the devices 16 are possible.

FIG. 8 is one example of a computing environment in which elements of FIG. 1, or parts of it, (for example) can be deployed. With reference to FIG. 8, an example system for implementing some embodiments includes a computing device in the form of a computer 810 programmed to operate as discussed above. Components of computer 810 may include, but are not limited to, a processing unit 820 (which can comprise processors or servers from previous FIGS.), a system memory 830, and a system bus 821 that couples various system components including the system memory to the processing unit 820. The system bus 821 may be any of several types of bus structures including a memory bus or memory controller, a peripheral bus, and a local bus using any of a variety of bus architectures. Memory and programs described with respect to FIG. 2 can be deployed in corresponding portions of FIG. 8.

Computer 810 typically includes a variety of computer readable media. Computer readable media can be any available media that can be accessed by computer 810 and includes both volatile and nonvolatile media, removable and non-removable media. By way of example, and not limitation, computer readable media may comprise computer storage media and communication media. Computer storage media is different from, and does not include, a modulated data signal or carrier wave. It includes hardware storage media including both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computer 810. Communication media may embody computer readable instructions, data structures, program modules or other data in a transport mechanism and includes any information delivery media. The term "modulated data signal" means a signal that has one or more of its characteristics set or changed in such a manner as to encode information in the signal.

The system memory 830 includes computer storage media in the form of volatile and/or nonvolatile memory such as read only memory (ROM) 831 and random access memory (RAM) 832. A basic input/output system 833 (BIOS), containing the basic routines that help to transfer information between elements within computer 810, such as during start-up, is typically stored in ROM 831. RAM 832 typically contains data and/or program modules that are immediately accessible to and/or presently being operated on by processing unit 820. By way of example, and not limitation, FIG. 8 illustrates operating system 834, application programs 835, other program modules 836, and program data 837.

The computer 810 may also include other removable/non-removable volatile/nonvolatile computer storage media. By way of example only, FIG. 8 illustrates a hard disk drive 841 that reads from or writes to non-removable, nonvolatile magnetic media, an optical disk drive 855, and nonvolatile optical disk 856. The hard disk drive 841 is typically connected to the system bus 821 through a non-removable memory interface such as interface 840, and optical disk drive 855 are typically connected to the system bus 821 by a removable memory interface, such as interface 850.

Alternatively, or in addition, the functionality described herein can be performed, at least in part, by one or more hardware logic components. For example, and without limitation, illustrative types of hardware logic components that can be used include Field-programmable Gate Arrays (FPGAs), Application-specific Integrated Circuits (e.g., ASICs), Application-specific Standard Products (e.g., ASSPs), System-on-a-chip systems (SOCs), Complex Programmable Logic Devices (CPLDs), etc.

The drives and their associated computer storage media discussed above and illustrated in FIG. 8, provide storage of computer readable instructions, data structures, program modules and other data for the computer 810. In FIG. 8, for example, hard disk drive 841 is illustrated as storing operating system 844, application programs 845, other program modules 846, and program data 847. Note that these components can either be the same as or different from operating system 834, application programs 835, other program modules 836, and program data 837.

A user may enter commands and information into the computer 810 through input devices such as a keyboard 862, a microphone 863, and a pointing device 861, such as a mouse, trackball or touch pad. Other input devices (not shown) may include a joystick, game pad, satellite dish, scanner, or the like. These and other input devices are often connected to the processing unit 820 through a user input interface 860 that is coupled to the system bus, but may be connected by other interface and bus structures. A visual display 891 or other type of display device is also connected to the system bus 821 via an interface, such as a video interface 890. In addition to the monitor, computers may also include other peripheral output devices such as speakers 897 and printer 896, which may be connected through an output peripheral interface 895.

The computer 810 is operated in a networked environment using logical connections (such as a controller area network—CAN, local area network—LAN, or wide area network WAN) to one or more remote computers, such as a remote computer 880.

When used in a LAN networking environment, the computer 810 is connected to the LAN 871 through a network interface or adapter 870. When used in a WAN networking environment, the computer 810 typically includes a modem 872 or other means for establishing communications over the WAN 873, such as the Internet. In a networked environment, program modules may be stored in a remote memory storage device. FIG. 8 illustrates, for example, that remote application programs 885 can reside on remote computer 880.

It should also be noted that the different examples described herein can be combined in different ways. That is, parts of one or more examples can be combined with parts of one or more other examples. All of this is contemplated herein.

Example 1 is a mobile work machine, comprising:

a frame;

a ground engaging implement;

a first grade control system that controls an orientation of the implement based on a geographic position signal received from a geographic position system;

a second automatic grade control system that automatically controls the orientation of the implement; and a grade control switching system that receives a presence signal indicative of a presence of the geographic position signal and automatically controls activation of the first grade control system and the second automatic grade control system based on the presence of the geographic position signal.

Example 2 is the mobile work machine of any or all previous examples and further comprising:

an angle identifier that identifies a predetermined target mainfall and cross slope of the grade while the first grade control system is controlling the orientation of the implement.

Example 3 is the mobile work machine of any or all previous examples wherein the angle identifier is configured to provide the identified predetermined target mainfall and cross slope to the second grade control system when the presence signal indicates that the geographic position signal is interrupted.

Example 4 is the mobile work machine of any or all previous examples wherein the implement comprises a blade and wherein the angle identifier comprises:

a blade orientation detector that detects an orientation of the blade; and a frame orientation detector that detects an orientation of the frame.

Example 5 is the mobile work machine of any or all previous examples and further comprising an operator interface mechanism, wherein the grade control switching system is configured to generate an operator notification on the operator interface mechanism indicative of switching between controlling activation of the first grade control system and controlling activation of the second grade control system.

Example 6 is the mobile work machine of any or all previous examples and further comprising:

a position detector that receives the geographic position signal and, based on the geographic position signal, generates a geographic position output indicative of the geographic position.

Example 7 is the mobile work machine of any or all previous examples wherein the geographic position system comprises a global navigation satellite system (GNSS) and wherein the position detector comprises:

a GNSS receiver.

Example 8 is the mobile work machine of any or all previous examples wherein the geographic position system comprises a local position system and wherein the position detector comprises:

a local position system receiver.

Example 9 is a method of controlling a mobile work machine that has a frame and a ground engaging implement, the method comprising:

receiving a geographic position signal from a geographic position system transmitter;

controlling an orientation of the implement, based on the geographic position signal, with a first grade control system;

detecting interruption of the geographic position signal; and automatically switching to controlling the orientation of the implement with a second automatic grade control system, different from the first grade control system.

Example 10 is the method of any or all previous examples and further comprising:

detecting a presence of the geographic position signal; and automatically switching to controlling the orientation of the implement with the first grade control system, based on the presence of the geographic position signal.

Example 11 is the method of any or all previous examples and further comprising identifying a predetermined target mainfall and cross slope of the grade while the first grade control system is controlling the orientation of the implement.

Example 12 is the method of any or all previous examples and further comprising:

providing the predetermined target mainfall and cross slope to the second grade control system when the presence signal indicates that the geographic position signal is interrupted.

Example 13 is the method of any or all previous examples wherein automatically switching to controlling the orientation of the implement with a second grade control system comprises:

controlling the orientation of the implement with the second grade control system based on the predetermined target mainfall and cross slope of the grade.

Example 14 is the method of any or all previous examples wherein the implement comprises a blade and wherein controlling the orientation of the implement with the second grade control system based on the predetermined target mainfall and cross slope comprises:

detecting an orientation of the blade; and detecting an orientation of the frame.

Example 15 is the method of any or all previous examples and further comprising:

generating an operator notification on an operator interface mechanism on the mobile work machine, the operator notification being indicative of switching between controlling the orientation of the implement with the first grade control system and controlling the orientation of the blade with the second grade control system.

Example 16 is the method of any or all previous examples wherein receiving the geographic position signal comprises:

receiving the geographic position signal with a global navigation satellite system (GNSS) receiver.

Example 17 is the method of any or all previous examples wherein receiving the geographic position signal comprises:

receiving the geographic position signal with a local position system receiver.

Example 18 is a control system for controlling a mobile work machine, the control system comprising:

one or more processors;

a data store that stores computer executable instructions which, when executed by the one or more processors cause the one or more processors to perform steps of:

receiving a geographic position signal from a geographic position system;

controlling an orientation of the implement, based on the geographic position signal, with a first grade control system;

detecting interruption of the geographic position signal;

based on detecting the interruption of the geographic position signal, automatically switching to controlling the orientation of the implement with a second automatic grade control system, different from the first grade control system;

detecting a presence of the geographic position signal; and automatically switching to controlling the orientation of the implement with the first grade control system, based on the presence of the geographic position signal.

Example 19 is the control system of any or all previous examples wherein the computer implemented instructions, when executed by the one or more processors, cause the one or more processors to perform steps of:

identifying a predetermined target mainfall and cross slope of grade while the first grade control system is controlling the orientation of the implement; and providing the predetermined target mainfall and cross slope to the second automatic grade control system when the presence signal indicates that the geographic position signal is interrupted.

Example 20 is the control system of any or all previous examples wherein automatically switching to controlling the orientation of the implement with a second automatic grade control system comprises:

controlling the orientation of the implement with the second automatic grade control system based on the predetermined target mainfall and cross slope.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A mobile work machine comprising:

a frame;

an implement coupled to the frame and configured to engage ground;

an actuator system comprising one or more actuators;

a first grade control system configured to control the actuator system to control a position of the implement, with respect to the frame, based on a geographic position signal received from a geographic position system;

a frame orientation sensor configured to sense a frame orientation of the frame, relative to a reference, during an instance when the first grade control system controlled the position of the implement with respect to the frame;

an implement orientation sensor configured to sense an implement orientation of the implement, with respect to the frame, during the instance when the first grade control system controlled the position of the implement with respect to the frame; and a grade control switching system configured to:

receive a presence signal indicative of a presence of the geographic position signal; and automatically control activation of a selected one of the first grade control system or a second grade control system based on the presence of the geographic position signal, wherein, during a time when the presence signal indicates that the geographic position signal is interrupted, the second grade control system is configured to:

obtain a target mainfall and a target cross slope, wherein the target mainfall and the target cross slope is based on:

the frame orientation of the frame during the instance when the first grade control system controlled the position of the implement with respect to the frame, and the implement orientation of the implement during the instance when the first grade control system controlled the position of the implement with respect to the frame; and control the actuator system to control the implement based on the target mainfall and the target cross slope.

2. The mobile work machine of claim 1 and further comprising:

a position detector that receives the geographic position signal and, based on the geographic position signal, generates a geographic position output indicative of a geographic position.

3. The mobile work machine of claim 2 wherein the geographic position system comprises a global navigation satellite system (GNSS) and wherein the position detector comprises:

a GNSS receiver.

4. The mobile work machine of claim 2 wherein the geographic position system comprises a local position system and wherein the position detector comprises:

a local position system receiver.

5. The mobile work machine of claim 1 and further comprising an operator interface mechanism, wherein the grade control switching system is configured to generate an operator notification on the operator interface mechanism indicative of switching between controlling activation of the first grade control system and controlling activation of the second grade control system.

6. The mobile work machine of claim 1 wherein the implement comprises a blade and wherein the implement orientation sensor comprises:

a blade orientation detector configured to detect the implement orientation of the blade with respect to the frame.

7. A method of controlling a mobile work machine that has a frame and a ground engaging implement, the method comprising:

receiving a geographic position signal from a geographic position system transmitter external to the mobile work machine;

controlling, with a first grade control system, a position of the ground engaging implement, with respect to the frame, based on the geographic position signal received from the geographic position system transmitter external to the mobile work machine;

detecting interruption of the geographic position signal received from the geographic position system transmitter external to the mobile work machine;

obtaining frame orientation data from a source internal to the mobile work machine, the frame orientation data indicating a frame orientation of the frame, relative to a reference, during an instance when the first grade control system controlled the position of the ground engaging implement with respect to the frame;

obtaining implement orientation data indicating an implement orientation of the ground engaging implement, with respect to the frame, during the instance when the first grade control system controlled the position of the ground engaging implement with respect to the frame; and automatically switching to controlling the ground engaging implement with a second grade control system, different from the first grade control system, while the geographic position signal, received from the geographic position system transmitter external to the mobile work machine, is interrupted, wherein controlling the ground engaging implement with the second grade control system comprises:

obtaining a target mainfall and a target cross slope, wherein the target mainfall and the target cross slope is based on:

the frame orientation of the frame during the instance when the first grade control system controlled the position of the ground engaging implement with respect to the frame, and the implement orientation of the ground engaging implement during the instance when the first grade control system controlled the position of the ground engaging implement with respect to the frame; and controlling the implement orientation of the ground engaging implement based on the target mainfall and the target cross slope.

8. The method of claim 7 wherein receiving the geographic position signal comprises:

receiving the geographic position signal with a global navigation satellite system (GNSS) receiver.

9. The method of claim 7 wherein receiving the geographic position signal comprises:

receiving the geographic position signal with a local position system receiver.

10. The method of claim 7 and further comprising:

detecting a presence of the geographic position signal; and automatically switching to controlling the implement orientation of the ground engaging implement with the first grade control system, based on the presence of the geographic position signal.

11. The method of claim 7 wherein obtaining the target mainfall and the target cross slope comprises:

identifying the target mainfall and the target cross slope of a grade while the first grade control system is controlling the implement orientation of the ground engaging implement.

12. The method of claim 11 and further comprising:

providing the target mainfall and the target cross slope to the second grade control system when the geographic position signal is interrupted.

13. The method of claim 12 wherein automatically switching to controlling the implement orientation of the ground engaging implement with the second grade control system comprises:

controlling the implement orientation of the ground engaging implement with the second grade control system based on the target mainfall and the target cross slope.

14. The method of claim 13 wherein the ground engaging implement comprises a blade.

15. The method of claim 14 and further comprising:

generating an operator notification on an operator interface mechanism on the mobile work machine, the operator notification being indicative of switching between controlling the implement orientation of the blade with the first grade control system and controlling the implement orientation of the blade with the second grade control system.

16. A mobile work machine comprising:

a frame;

an implement coupled to the frame;

a first grade control system configured to:

receive a geographic position signal from a geographic position system;

control, at a first time, a position of the implement relative to the frame based on the geographic position signal;

a frame orientation sensor configured to sense a frame orientation of the frame, relative to a reference, during the first time;

an implement orientation sensor configured to sense an implement orientation of the implement, with respect to the frame, during the first time;

a second grade control system configured to obtain a target mainfall and a target cross slope based on the implement orientation and the frame orientation; and a control switching system configured to:

detect interruption of the geographic position signal;

based on the interruption of the geographic position signal, automatically switch to controlling the implement with the second grade control system, wherein the second grade control system is configured to control the implement based on the target mainfall and the target cross slope;

detect a presence of the geographic position signal; and automatically switch to controlling the implement with the first grade control system, based on the presence of the geographic position signal.

17. The mobile work machine of claim 16 wherein the first grade control system is configured to:

identify the target mainfall and the target cross slope while the first grade control system is controlling the implement orientation of the implement; and provide the target mainfall and the target cross slope to the second grade control system when the geographic position signal is interrupted.

18. The mobile work machine of claim 17 wherein the second grade control system is configured to:

control the implement orientation of the implement based on the target mainfall and the target cross slope.

19. The mobile work machine of claim 16 wherein the geographic position system comprises at least one of a satellite-based geographic positioning system or a local positioning system.

* * * * *